US005829209A

United States Patent [19]

Keyl

[11] Patent Number: 5,829,209

[45] Date of Patent: Nov. 3, 1998

[54] METHOD OF MANUFACTURING A SILO OR TANK WITH A LINING, AND A WALL SHEET FOR MANUFACTURING A SILO OR TANK

[75] Inventor: Ruud V.D. Keyl, Heerenveen, Netherlands

[73] Assignee: Industrial Storage Systems B.V., Drachten, Netherlands

[21] Appl. No.: 696,696

[22] Filed: Aug. 14, 1996

[30] Foreign Application Priority Data

Aug. 14, 1995 [NL] Netherlands ..... 1000980

[51] Int. Cl.[6] ..... E04H 7/30; B65D 90/04

[52] U.S. Cl. ..... 52/192; 52/249; 52/416; 427/421; 427/284; 427/299; 220/567

[58] Field of Search ..... 52/192, 197, 249, 52/416, 418, 591.5; 220/565, 567; 427/421, 242, 284, 299

[56] References Cited

U.S. PATENT DOCUMENTS

| | | | |
|---|---|---|---|
| 2,235,937 | 3/1941 | Linberg . | |
| 2,729,313 | 1/1956 | Ernestus . | |
| 3,009,824 | 11/1961 | Boynton et al. . | |
| 4,188,759 | 2/1980 | Liet et al. | 52/192 X |
| 4,479,334 | 10/1984 | Goode | 52/197 |
| 4,602,463 | 7/1986 | Holowatyj | 52/197 |
| 4,603,525 | 8/1986 | Byers et al. | 52/249 X |
| 4,625,478 | 12/1986 | Goode | 52/197 |
| 4,718,208 | 1/1988 | Fons | 52/192 |

FOREIGN PATENT DOCUMENTS

| | | | |
|---|---|---|---|
| 0637553A1 | 2/1995 | European Pat. Off. . | |
| 1037177 | 7/1966 | United Kingdom . | |
| 2218454 | 11/1989 | United Kingdom | 52/192 |

OTHER PUBLICATIONS

"Laminate Linings Are Alternative to Storage–Tank Replacement" Oil & Gas Journal, No. 17, Apr. 25, 1988, Tulsa, Oklahoma.

*Primary Examiner*—Carl D. Friedman
*Assistant Examiner*—Winnie S. Yip
*Attorney, Agent, or Firm*—Evenson, McKeown, Edwards & Lenahan, PLLC

[57] ABSTRACT

A method of manufacturing a silo or tank with a lining by using preformed wall sheets comprising, along the edges thereof, edge zones provided with bolt holes for connecting the wall sheets to each other with slight overlap, wherein wall sheets are used prefabricated with a coating layer applied to the inside of the wall sheets under controlled conditions by spraying, spreading or the like, which coating layer covers the entire inner surface of the wall sheet, but leaves free the edge zones of two connecting edges; that the prefabricated wall sheets are then brought to the building site and connected to each other in such a manner that in each case a coated edge zone of a wall sheet lies on the inside on a free edge zone of another wall sheet; that at least on the inside the seams between the wall sheets are provided with a cemented joint and the heads of the bolts or the like are likewise provided with a layer of coating material.

10 Claims, 1 Drawing Sheet

METHOD OF MANUFACTURING A SILO OR TANK WITH A LINING, AND A WALL SHEET FOR MANUFACTURING A SILO OR TANK

BACKGROUND OF THE INVENTION

1. Field of the Invention

The invention relates to a method of building up a silo or tank with a lining by means of preformed wall sheets connected to each other by means of screw connections or the like for forming a complete silo wall. The invention further relates to a wall sheet for building up a silo.

2. Description of Related Art

It is already known to build up silos for storage of industrial and agrarian products, such as for instance manure, of preformed sheets provided with bolt holes, screwed together with slight overlap to form a normally round silo wall, which is built up on a priorly arranged bottom or supporting edge, and which may later be provided with a suitable roof, if desired. Such silos may for instance be built up of stainless-steel wall sheets or zinc-coated sheets or enamelled wall sheets or the like. Normally, the preformed wall sheets are substantially rectangular and are provided, in the edge areas thereof, with a plurality of holes for bolts or the like, by means of which the wall sheets can be attached to each other with an overlap, with the interposition of a suitable sealing material.

If a thus constructed silo is intended for storage of aggressive substances, it is often necessary to provide a special lining of a material resistant to the substances in question, because the sealing material and/or the material of the wall sheets employed is (are) not resistant to the substances to be stored in the silo.

Applicants' European patent application 0 637 553 describes a method of building up a silo or tank of preformed wall sheets provided with a lining, by using wall sheets provided, along the edges thereof, with bolt holes, which bolt holes in zones located along at least two connecting edges are provided with fastening members secured against rotation. The zones already provided with the fastening members and the rest of each wall sheet are covered, on the inside thereof, by a layer of lining material bonded to the wall sheet, leaving free two other free edge zones provided with bolt holes, which layer of lining material extends by free edge strips beyond the edges of the zones having bolt holes provided with fastening members. The wall sheets are then fastened to each other by means of the fastening members and the bolt holes in such a manner that the free edge strips of the layer of lining material of one wall sheet cover the free edge zones of two adjacent wall sheets. Finally, the adjacent edges of the layers of lining material of different wall sheets are welded together or cemented or the like.

The technique described in European patent application 0 637 553 renders it possible to build silos and tanks that are up to very high standards with respect to the nature, for instance the degree of aggressiveness, of the substances to be stored in the silos or tanks. Furthermore, the technique described in European patent application 0 637 553 is eminently suited for building silos or tanks in very remote places, since on the building site itself only relatively simple and easily transported tools and equipment are required.

In practice, however, it is not always necessary that a silo or tank to be built comes up to the most rigid standards with respect to the nature of the substances to be stored, nor are the building sites for a silo or tank always in very remote places.

Since, moreover, the known technique is relatively expensive and, because of the projecting free edge strips of lining material, requires special attention upon transport of the wall sheets, there is also a need for a simpler method of manufacturing a silo or tank with a lining.

SUMMARY OF THE INVENTION

The object of the invention is to meet the above need and, in general, to provide an effective method of manufacturing a silo or tank with a lining. To this end, according to the invention, a method of the above type is characterized in that wall sheets are used prefabricated with a coating layer applied to the inside of the wall sheets under controlled conditions, which coating layer covers the entire inner surface of the wall sheet, but leaves free the edge zones of two connecting edges; that the prefabricated wall sheets are then brought to the building site of the silo or tank and connected to each other in such a manner that in each case a coated edge zone of a wall sheet comes to lie on the inside on a free edge zone of another wall sheet; that at least on the inside the seams between the wall sheets are provided with a cemented joint and the heads of the bolts or the like passed through the bolt holes are likewise provided with a layer of coating material.

BRIEF DESCRIPTION OF THE DRAWINGS

The invention will be explained below in more detail with reference to the accompanying drawings, in which.

DESCRIPTION OF THE PREFERRED EMBODIMENT

Figure 1:
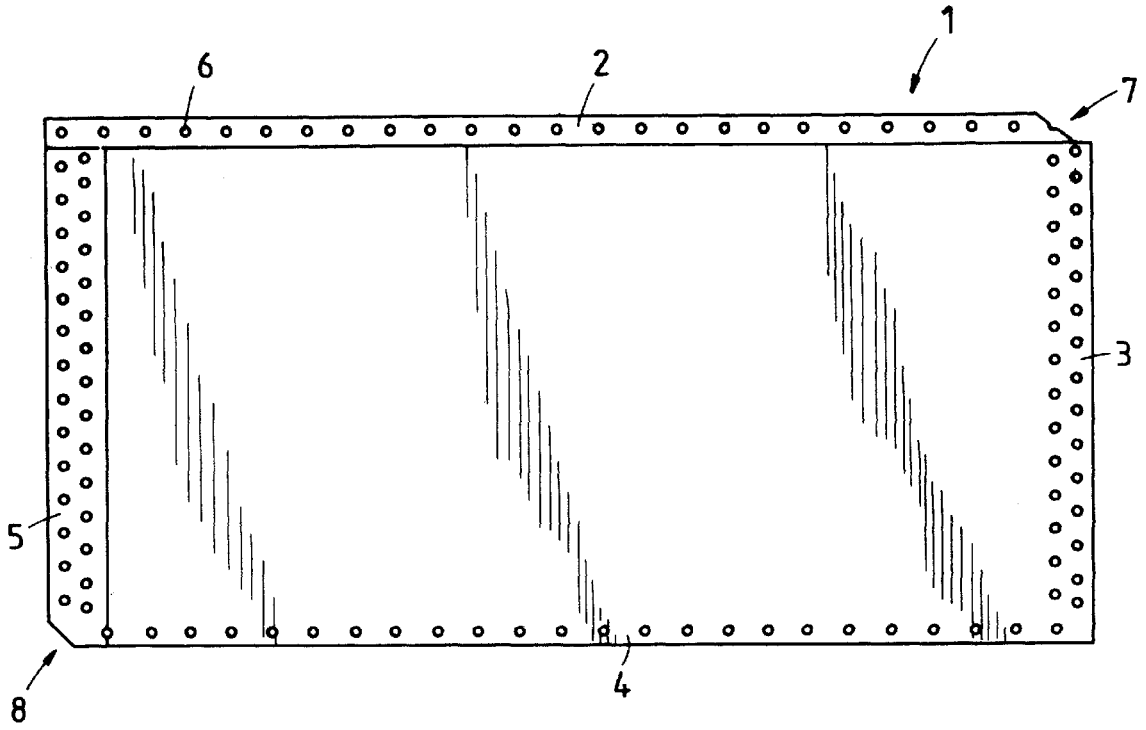
FIG. 1 schematically shows an inside view of an example of a wall sheet for a silo or tank according to the invention.

FIG. 1 schematically shows an inside view of an example of a wall sheet 1, suitable for use in the manufacture of a silo or tank according to the invention. As is conventional, the wall sheet shown is of rectangular shape and is curved in a plane transverse to the plane of the paper, in agreement with the dimensions and shape of the silo or tank to be built. This, however, is not shown by FIG. 1. In edge zones 2 through 5, extending throughout the length of the edges of the wall sheet, the wall sheet is provided with bolt holes 6. In the example shown, the vertical edge zones 3 and 5 are each provided with two rows of bolt holes, while the horizontal edge zones 2 and 4 each have a single row of bolt holes. Although above and below the term bolt holes is always used and bolts and nuts are indeed often used to fasten the wall sheets together, other fastening methods, e.g. riveting, are not excluded.

The wall sheet 1 shown has two diagonally opposed bevelled corners 7, 8. This measure serves to reduce the thickening up occurring at the location of these corner points in the mounted silo or tank as a result of a multiple overlap of wall sheets.

The wall sheets may be made of any suitable material, for instance stainless steel, zinc-coated steel or the like. Particularly suitable is enamelled sheet steel, in which connection preferably both sides of the wall sheets are enamelled. According to the invention the inner surfaces of the wall sheets are provided in the factory with a coating of suitable material. The nature of the material is in agreement with the intended use of the silo or tank to be constructed, and the material must of course be selected so as to have the required durable chemical and physical resistance. The coating material may be a synthetic resin material composed of one or more components. The coating is applied in the factory under controlled conditions, for instance with a roller or with a brush or by spraying, so that an optimum bond to the base sheet is obtained. If necessary, the base sheets may be pretreated to make the surface, for instance, dust- and fat-free and to roughen it. To this end, the base sheets may, for instance, be sandblasted or etched and/or treated with a bond-promoting agent. If desired, an intermediate fabric layer may also be applied.

The pattern of application is such that in each case two connecting edge zones, in FIG. 1 the edge zones 2 and 5, remain free of coating material. To this end, the edge zones 2 and 5 may, for instance, be taped up or otherwise screened during application of the coating material. If desired, the pretreatment and/or the intermediate layer may include these free edge zones as well. Thus it can be achieved that after mounting the tank or silo the coatings of the sheets substantially connect to each other. If required, before mounting the sheets the free edge zones may be provided on the building site with a (thin) layer of coating material, for instance by spraying. Besides, a thinner layer could be applied to the free edge zones already in the factory.

Subsequently, the sheets with bolts or the like passed through the bolt holes from the inside of the sheets are connected to each other to finally form a silo or tank. The edges of the sheets, as well as the bolt heads, are then given a separate treatment, at least on the inside, as will be discussed below with reference to FIG. 2.

Figure 2:
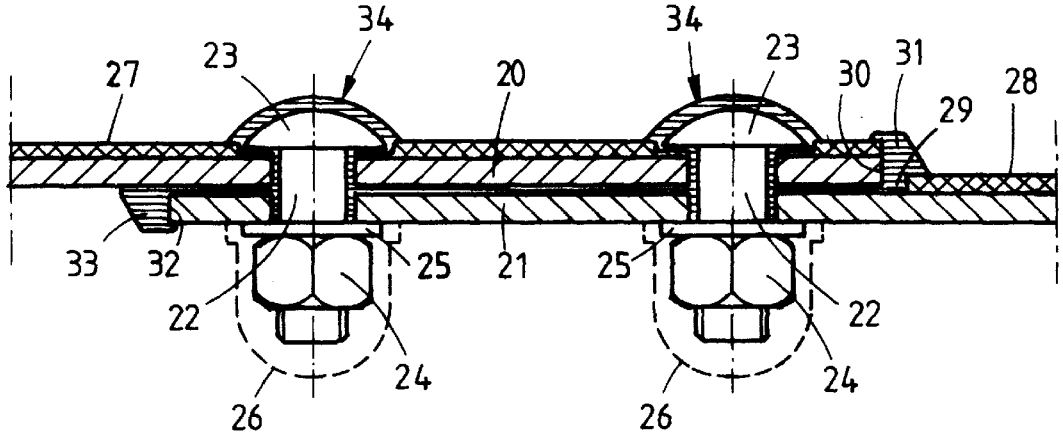
FIG. 2 schematically shows, in section, the connecting zone between two wall sheets of the type shown in FIG. 1.

FIG. 2 schematically shows a section of the connecting zone between two wall sheets 20, 21 according to the invention. The wall sheets are connected to each other at the location of the section by two rows of bolts. Two bolts 22 are shown in FIG. 2. The bolts can be of different construction, as described in for instance European patent application 0 637 553. In the example of FIG. 2, bolts with a smooth round head 23 are used, as well as hexagonal nuts 24 and washers 25. The nuts located on the outside of the silo or tank are preferably covered with a plastic cap 26.

The layer of coating material of the sheet 20 is designated by 27. This layer also extends over the edge zone of the sheet 20 shown, provided with bolt holes. Consequently, this is the zone corresponding to the edge zone 3 of FIG. 1.

The layer of coating material of the sheet 21 is designated by 28. This layer leaves free the edge zone of the sheet 21 shown in FIG. 2, so that this is the edge zone of the sheet 21 corresponding to the edge zone 5 of FIG. 1. The sheet 20 rather accurately covers the free edge zone of the sheet 21. At the location of the seam 29 between the end edge 30 of the sheet 20 and the coated inner surface of the sheet 21 is located a cemented joint 31. Preferably, the cement is made of the same base material as the coating layer, but with another viscosity. To this end, for instance materials having thixotropic properties may be used. The cemented joint 31 covers the end edge of the sheet 20 and fills an interspace, if any, between the coating 28 and the end edge 30. Subject to the type of cement, a connection of the fresh cement to the old (prefabricated) coating layer is formed by chemical reaction or bonding, which is up to the standards prevailing for cements. As already observed, a further layer of coating material may be applied between the overlapping portions of the sheets. This, however, is not shown in FIG. 2.

On the outside a further cemented joint 33 is applied, preferably at the location of the end edge 32 of the sheet 21, as shown in this example, for which cemented joint 33 the same material is preferably but not necessarily used as for the cemented joint 31.

On the inside, after mounting, the bolt heads are sprayed or smeared with fresh coating material, so that a layer designated by 34, which is for instance 2 mm or more in thickness, is obtained, which connects to the prefabricated layer 27.

It is observed that bottom or roof sheets, if any, may be similarly prefabricated and mounted.

In silos having for instance a concrete floor a cemented joint is further applied in the corner between wall and floor, while the floor, whether or not after pretreatment, could be provided on the building site with a coating layer of preferably the same material as the wall coating layer.

It is observed that, in addition, existing silos or tanks may be provided with a similar lining layer. The silos or tanks are then cleaned and pretreated first. Subsequently, the inner wall is provided with coating material, for instance by spraying, under optimally controlled conditions. The bolt heads may then be coated simultaneously. Subsequently, if desired, a cemented joint may be applied to the seams between the sheets. The latter, however, could also be done before application of the coating material. On the outside, too, the seams can be covered by a cemented joint. This system can be used for both metal and concrete silos.

It is observed that in view of the above, various modifications will readily occur to a skilled person. Thus, if desired, after treatment of the bolt heads the entire inner wall could be provided with an additional coating layer, whether or not after application of the cemented joints between the sheets. If desired, the bolt heads may also be pretreated in the factory or on the building site. Furthermore, auxiliaries, such as wall passage means and the like, can of course also be provided with a similar coating layer and cemented joint.

Instead of a first coating layer applied by spraying or the like, which layer leaves two edge zones (2 and 5) free, it is also possible to apply, if desired, a preformed coating layer, which is glued for instance to the wall sheet. Such modifications are understood to fall within the scope of the invention.

I claim:

1. A method of manufacturing a silo or tank with a lining comprising the steps of:

providing preformed wall sheets including edge zones with bolt holes for connecting the wall sheets to each other with slight overlap by bolts;

applying coating layers to inner surfaces of the wall sheets under controlled conditions so that, coating layer cover the entire inner surfaces of the wall sheets except for coating-free edge zones of two connecting edges on each of the wall sheets;

transporting the wall sheets to a building site of a silo or tank;

laying one of the coating-free outside surface of a first wall sheet edge zone on a coating-free edge zones of a second wall sheet inner surface;

connecting the wall sheets to each other by passing the bolts through the bolt holes in each of said first and second wall sheets;

providing seams between the wall sheets with a cemented joints; and coating each exposed head of the bolts passed through the bolt holes with a layer of coating material which bonds to one of the coating layers.

2. A method according to claim 1, and further comprising the step of pretreating the wall sheets before application of the coating layer to effect better bonding of the coating layer.

3. A method according to claim 2, wherein pretreating is performed by applying an intermediate layer.

4. A method according to claim 3, wherein the intermediate layer comprises a fabric layer.

5. A method according to claim 2, and further comprising the step of also pretreating the coating-free edge zones.

6. A method according to claim 1, and further comprising the step of providing the coating-free edge zones with a thin layer of coating material after transporting the wall sheets to the building site.

7. A method according to claim 1, and further comprising the step of using at least a number of wall sheets with holes in said edge zones with larger dimensions than diameters of the bolts.

8. A method according to claim 1, wherein the cemented joint is of the same base material, but with a higher viscosity, as the coating layers.

9. A method according to claim 1, and further comprising the step of providing a cemented joint on an outside of said seams.

10. A method according to claim 1, wherein the coating layer is applied by spraying, spreading or the like.

* * * * *